US008120512B2

(12) United States Patent
Cargonja et al.

(10) Patent No.: US 8,120,512 B2
(45) Date of Patent: Feb. 21, 2012

(54) METHOD AND APPARATUS FOR DETECTING A PATH OF TRAVEL OR DIRECTION OF TRAVEL

(75) Inventors: Nikola Cargonja, San Carlos, CA (US); Albert Nardelli, Mountain View, CA (US)

(73) Assignee: Savi Technology, Inc., Mountain View, CA (US)

( * ) Notice: Subject to any disclaimer, the term of this patent is extended or adjusted under 35 U.S.C. 154(b) by 22 days.

(21) Appl. No.: 11/477,157

(22) Filed: Jun. 28, 2006

(65) Prior Publication Data

US 2008/0001783 A1 Jan. 3, 2008

(51) Int. Cl.
*G08G 1/09* (2006.01)

(52) U.S. Cl. ..... 340/905; 340/572.1; 340/10.1

(58) Field of Classification Search ..... 340/905, 340/572.1, 10.1

See application file for complete search history.

(56) References Cited

U.S. PATENT DOCUMENTS

| | | | | |
|---|---|---|---|---|
| 4,112,421 | A * | 9/1978 | Freeny, Jr. | 342/457 |
| 4,217,588 | A | 8/1980 | Freeny, Jr. | |
| 5,490,079 | A | 2/1996 | Sharpe et al. | |
| 5,631,642 | A * | 5/1997 | Brockelsby et al. | 340/993 |
| 5,790,946 | A | 8/1998 | Rotzoll | |
| 5,887,842 | A | 3/1999 | Granger | |
| 5,977,913 | A | 11/1999 | Christ | |
| 6,208,235 | B1 | 3/2001 | Trontelj | |
| 6,496,112 | B1 | 12/2002 | Vega | |
| 6,542,114 | B1 | 4/2003 | Eagleson et al. | |
| 6,720,888 | B2 | 4/2004 | Eagleson et al. | |
| 6,726,099 | B2 | 4/2004 | Becker et al. | |
| 6,765,484 | B2 * | 7/2004 | Eagleson et al. | 340/505 |
| 6,940,392 | B2 | 9/2005 | Chan et al. | |
| 6,958,677 | B1 | 10/2005 | Carter | |
| 7,024,331 | B2 * | 4/2006 | Jones et al. | 702/150 |
| 7,187,278 | B2 | 3/2007 | Biffar | |
| 2003/0013146 | A1 | 1/2003 | Werb | |
| 2003/0030568 | A1 | 2/2003 | Lastinger et al. | |
| 2003/0104848 | A1 | 6/2003 | Brideglall | |
| 2004/0263319 | A1 | 12/2004 | Huomo | |
| 2005/0035862 | A1 | 2/2005 | Wildman et al. | |
| 2005/0093679 | A1 | 5/2005 | Zai et al. | |
| 2006/0109109 | A1 | 5/2006 | Rajapakse et al. | |

(Continued)

OTHER PUBLICATIONS

Office Action mailed Nov. 27, 2007 in U.S. Appl. No. 11/329,379, filed Jan. 10, 2006.

(Continued)

*Primary Examiner* — George Bugg
*Assistant Examiner* — Kerri McNally
(74) *Attorney, Agent, or Firm* — Haynes and Boone, LLP

(57) ABSTRACT

Spaced first and second signposts transmit wireless signals containing different signpost identifications. A first path of travel passes through the transmission range of the first signpost, and a second path of travel passes through the transmission range of the second signpost but not the transmission range of the first signpost. A different configuration includes plural hallways extending away from a common intersection in respective directions, with a respective signpost in each hallway that transmits wireless signals containing a respective different signpost identification. Another configuration includes a hallway with first and second portions of different width, a first signpost in the first portion transmitting wireless signals containing a first signpost identification, and spaced second and third signposts in the second portion each transmitting wireless signals containing a second signpost identification different from the first signpost identification, and having a transmission range less than a width of the second portion.

36 Claims, 8 Drawing Sheets

U.S. PATENT DOCUMENTS

| | | | |
|---|---|---|---|
| 2006/0261951 | A1 | 11/2006 | Koerner et al. |
| 2007/0057789 | A1 | 3/2007 | Hamerly et al. |
| 2007/0120736 | A1 | 5/2007 | MacKenzie et al. |
| 2007/0159357 | A1 | 7/2007 | Cargonja et al. |
| 2007/0159358 | A1 | 7/2007 | Cargonja et al. |
| 2007/0159359 | A1 | 7/2007 | Cargonja et al. |
| 2007/0159360 | A1 | 7/2007 | Cargonja et al. |
| 2007/0262144 | A1 | 11/2007 | Cargonja et al. |

OTHER PUBLICATIONS

Office Action mailed Jan. 16, 2008 in U.S. Appl. No. 11/328,728, filed Jan. 10, 2006.
Office Action mailed Jan. 24, 2008 in U.S. Appl. No. 11/329,411, filed Jan. 10, 2006.
Office Action mailed May 29, 2008 in U.S. Appl. No. 11/329,379, filed Jan. 10, 2006.
Office Action mailed Aug. 20, 2008 in U.S. Appl. No. 11/329,415, filed Jan. 10, 2006.
Office Action mailed Jul. 25, 2008 in U.S. Appl. No. 11/328,728, filed Jan. 10, 2006.
Office Action mailed Feb. 4, 2009 in U.S. Appl. No. 11/329,415, filed Jan. 10, 2006.
Office Action mailed Aug. 6, 2008 in U.S. Appl. No. 11/329,411, filed Jan. 10, 2006.
Office Action mailed Feb. 10, 2009 in U.S. Appl. No. 11/329,411, filed Jan. 10, 2006.
Notice of Allowance mailed Jan. 27, 2009 in U.S. Appl. No. 11/328,728, filed Jan. 10, 2006.
Office Action mailed Nov. 19, 2008 in U.S. Appl. No. 11/329,379, filed Jan. 10, 2006.
Steve Koerner and David Worthy, U.S. Appl. No. 60/675,280, filed Apr. 26, 2005 for "RFID System with Infrared Localization".
Notice of Allowance mailed Apr. 30, 2009 in U.S. Appl. No. 11/329,415, filed Jan. 10, 2006.
Notice of Allowance mailed Jul. 31, 2009 in U.S. Appl. No. 11/329,411, filed Jan. 10, 2006.
Office Action mailed Jun. 23, 2009 in U.S. Appl. No. 11/329,379, filed Jan. 10, 2006.
Office Action mailed Jan. 15, 2010 in U.S. Appl. No. 11/329,379, filed Jan. 10, 2006.
Panel Decision mailed Jun. 9, 2010 in U.S. Appl. No. 11/329,379, filed Jan. 10, 2006.

* cited by examiner

START
DISCARD STORED SIGNPOST IDs. SET COUNTER = 0. DISABLE TIMER
261
262
TIMER EXPIRE ?
YES
NO
266
RECEIVED SIGNPOST SIGNAL?
NO
YES
267
START TIMER
268
SIGNPOST ID ALREADY STORED?
YES
271
SLEEP MODE
NO
272
STORE SIGNPOST ID
COUNTER = 0?
YES
273
NO
SET COUNTER = GROUP SIZE
276
277
DECREMENT COUNTER
COUNTER = 0?
NO
YES
278
263
NORMAL MODE. TRANSMIT STORED SIGNPOST IDs

START
401
DISCARD STORED SIGNPOST IDs. SET COUNTER = 0
402
DETECT SIGNPOST FIELD ?
NO
YES
403
DETECT SIGNPOST FIELD ?
NO
YES
407
RECEIVED SIGNPOST SIGNAL?
NO
YES
408
SIGNPOST ID ALREADY STORED?
YES
411
SLEEP MODE
NO
412
STORE SIGNPOST ID
COUNTER = 0?
YES
413
NO
SET COUNTER = GROUP SIZE
416
417
DECREMENT COUNTER
COUNTER = 0?
NO
YES
418
406
NORMAL MODE. TRANSMIT STORED SIGNPOST IDs

METHOD AND APPARATUS FOR DETECTING A PATH OF TRAVEL OR DIRECTION OF TRAVEL

FIELD OF THE INVENTION

This invention relates in general to tracking techniques and, more particularly, to techniques for tracking items or vehicles using radio frequency identification technology.

BACKGROUND

According to an existing technique for tracking items or vehicles, a device known as a radio frequency identification (RFID) tag is mounted on each item or vehicle that is to be tracked. Signposts that transmit short-range signpost signals are provided near locations where tags are likely to pass, for example near a door through which tags routinely travel. The tags can receive the signpost signals from nearby signposts, and can also transmit wireless tag signals that include information from the signpost signals. The tag signals typically have an effective transmission range that is significantly longer than the effective transmission range of the signpost signals. Stationary devices commonly known as readers are provided to receive the tag signals. Existing systems of this type have been generally adequate for their intended purposes, but have not been satisfactory in all respects.

BRIEF DESCRIPTION OF THE DRAWINGS

A better understanding of the present invention will be realized from the detailed description that follows, taken in conjunction with the accompanying drawings, in which.

DETAILED DESCRIPTION

Figure 1:
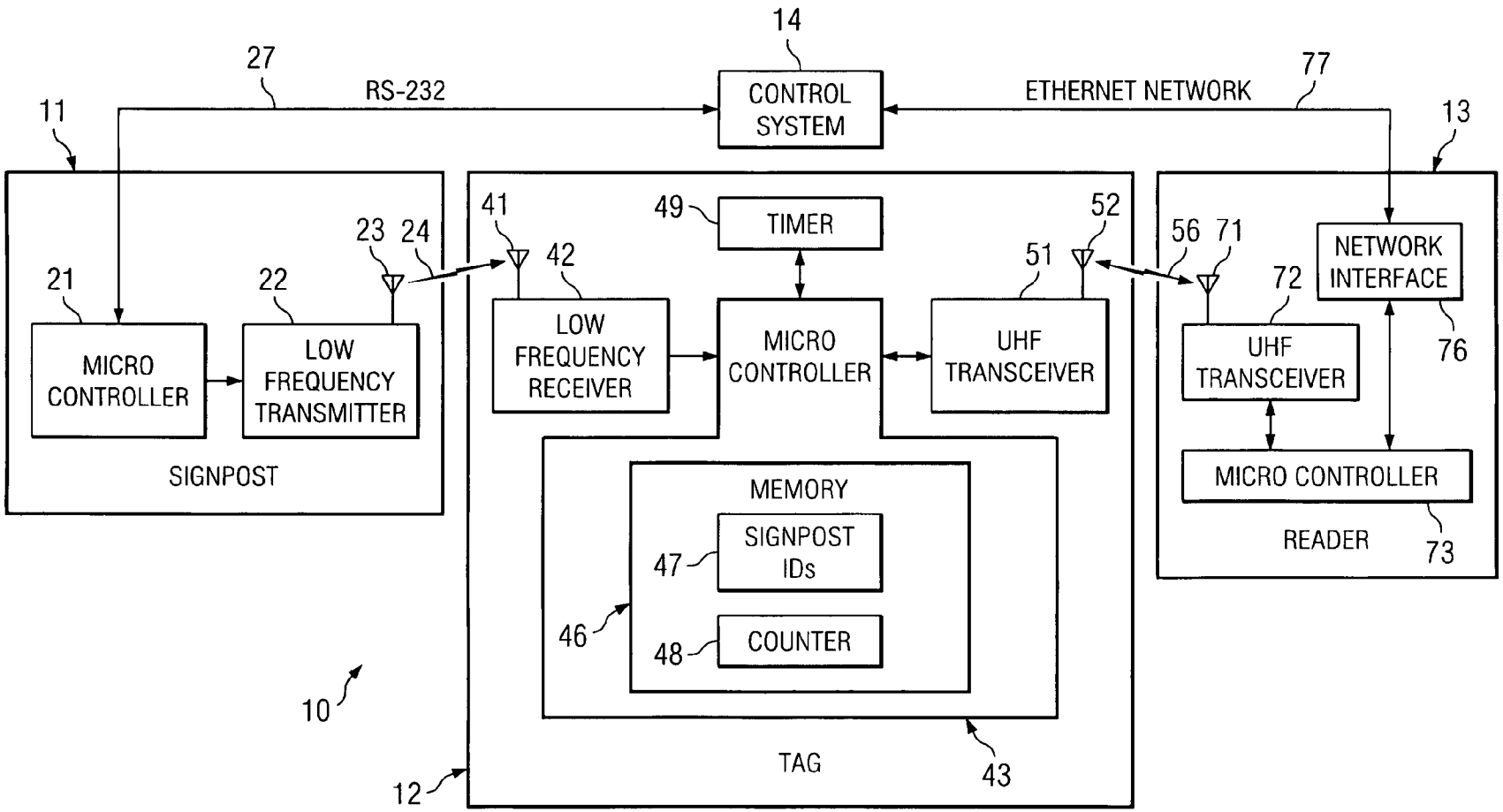
FIG. 1 is a block diagram of an apparatus that embodies aspects of the present invention, and that includes a signpost, a radio frequency identification tag, a reader, and a control system.

FIG. 1 is a block diagram of an apparatus 10 that embodies aspects of the present invention. The apparatus 10 includes a signpost 11, a radio frequency identification (RFID) tag 12, a reader 13, and a control system 14. The apparatus 10 actually includes many signposts of the type shown at 11, many tags of the type shown at 12, and several readers of the type shown at 13. However, for clarity in the discussion that follows, FIG. 1 shows only one signpost 11, one tag 12, and one reader 13. In the disclosed embodiment, the signpost 11 and the reader 13 are stationary, and the tag 12 can move relative to them. For example, the tag 12 may be mounted on a not-illustrated vehicle (such as a truck or forklift), or may be mounted on an item that is being transported (such as a box containing a television set).

The signpost 11 includes a microcontroller 21. Persons skilled in the art are familiar with the fact that a microcontroller is an integrated circuit having a microprocessor, having a read-only memory (ROM) that contains a computer program and static data for the microprocessor, and having a random access memory (RAM) in which the microprocessor can store dynamic data during system operation. The signpost 11 also includes a low frequency transmitter 22 that is controlled by the microcontroller 21, and that is coupled to an antenna 23. The microcontroller 21 can use the transmitter 22 to transmit a low frequency signpost signal 24 through the antenna 23. The transmitter 22 is a type of circuit known to those skilled in the art, and is therefore not illustrated and described here in detail. The antenna 23 can be a ferrite core antenna and/or a planar coil antenna of a known type, or any other suitable form of antenna. The antenna 23 is configured to transmit an omni-directional signal, but the antenna could alternatively be configured to transmit a signal that is to some extent directional.

In the embodiment shown in FIG. 1, the transmitter 22 generates the signpost signal 24 by effecting amplitude modulation of a carrier signal, where the carrier signal can have a frequency within a range of approximately 30 KHz to 30 MHz. Various countries have different governmental regulations regarding electromagnetic emissions. With due regard to these governmental regulations, the carrier frequency in the embodiment of FIG. 1 is selected to be 123 KHz, but could alternatively be some other frequency, such as 125 KHz, 132 KHz or 13.56 MHz. A further consideration in the selection of a carrier frequency is that the signpost signals 24 are to exhibit near field characteristics of a primarily magnetic character.

In this regard, electromagnetic signals have both an electric component (the "E" field) and a magnetic component (the "H" field). The magnetic field (H field) has a significantly higher roll-off than the electric field (E field). Consequently, it is possible for the magnetic field to be significant in the near field, or in other words at locations near the transmitter. However, the electric field will always dominate in the far field, or in other words at locations remote from the transmitter. The low frequency transmitter 22 and the antenna 23 are configured so that the magnetic field (H field) dominates in the near field. Consequently, the transmission and reception of the signpost signals 24 may be viewed as more of a magnetic coupling between two antennas, rather than a radio frequency coupling. As a result, the signpost signals 24 intentionally have a relatively short transmission range. This transmission range is adjustable but, in the disclosed embodiment, is typically about four to twelve feet. The localized nature of the signals 24 helps to facilitate compliance with governmental regulations. It also helps to minimize reception of these signals by tags that are not in the general vicinity of the signpost 11, but instead are beyond an intended transmission range of the signpost signals 24.

The signpost 11 is operatively coupled to the control system 14 through an interface 27. In the embodiment of FIG. 1, the interface 27 is a standard RS-232 serial interface. However, the interface 27 could alternatively be any other suitable type of interface, including but not limited to an Ethernet interface, an RS-485 interface, or a wireless interface.

The signpost 11 transmits the signpost signal 24 at periodic intervals. The time interval between successive transmissions may be configured to be relatively small, such as 100 msec, or may be configured to be relatively large, such as 24 hours, depending on the particular circumstances. The signpost signals 24 contain information that is discussed in more detail later.

The signpost signals 24 are often transmitted in a relatively noisy environment. In order to ensure reliable signal reception, known techniques may be used to improve the signal-to-noise ratio (SNR). In the embodiment of FIG. 1, the amplitude modulation of the 123 KHz carrier is effected using the well-known technique of amplitude shift keying (ASK), in order to improve the SNR. Alternatively, it would be possible to use frequency shift keying (FSK) or phase shift keying (PSK) to achieve an even higher SNR. However, FSK and PSK would typically require additional front-end analog circuitry in each of the tags 12. Therefore, and since it is desirable to be able to implement both the signpost 11 and the tag 12 at a relatively low cost, the embodiment of FIG. 1 uses ASK to achieve a reduced SNR.

Turning to the tag 12, the tag 12 includes an antenna 41 that receives the signpost signals 24 transmitted by the signpost 11. The antenna 41 is coupled to a low frequency receiver 42 of a known type. The receiver 42 is coupled to a microcontroller 43. The receiver 42 receives the signpost signals 24, extracts information from them, and then supplies this information to the microcontroller 43.

The microcontroller includes a memory that is shown diagrammatically at 46. Among other things, the microcontroller can store signpost identification information at 47 within the memory 46, as discussed in more detail later. The microcontroller 43 also has a memory location 48 that it uses as a counter, for a purpose discussed in more detail later. The tag 12 includes a timer 49 that can be used by the microcontroller 43 to measure a time interval, as explained in more detail later.

In FIG. 1, the circuitry within the tag 12 is powered by a not-illustrated battery. The tag 12 has at least two different modes of operation, including a normal operational mode, and a sleep mode. In the sleep mode, some or all of the circuitry within the tag 12 is powered down, in order to conserve battery power. In other words, the sleep mode is a reduced power mode in comparison to the normal operational mode.

The microcontroller 43 controls an ultra high frequency (UHF) transceiver 51 of a known type. The transceiver 51 is coupled to a known type of antenna 52. In the disclosed embodiment, the antenna 52 is omni-directional, but the antenna 52 could alternatively be configured to be directional. As is known in the art, it would be possible for the tag 12 to have two antennas at 56 that are perpendicular to each other, in order to facilitate more reliable reception of signpost signals 24. However, for simplicity and clarity, FIG. 1 shows only one antenna at 52.

Using the transceiver 51 and the antenna 52, the microcontroller 43 of the tag 12 can transmit tag signals at 56 to the reader 13, and can receive reader signals transmitted at 56 by the reader 13. In the embodiment of FIG. 1, the tag signals 56 are generated by FSK modulation of certain information onto a radio frequency (RF) carrier signal. This carrier signal has a frequency of 433.92 MHz, but it could alternatively have any other suitable frequency. One possible alternative frequency is 915 MHz. However, the embodiment of FIG. 1 uses the frequency of 433.92 MHz, because it is available for use in a larger number of countries under current governmental regulations regarding the transmission of electromagnetic signals.

The transmission range for the UHF signals 56 is substantially longer than that for the signpost signals 24. As discussed above, the transmission range of the signpost signals 24 is about 4 to 12 feet. In the disclosed embodiment, the transmission range for the UHF signals 56 can be up to about 300 feet. The signals 56 contain information that is explained in more detail later.

In FIG. 1, the reader 13 includes an antenna 71 that is coupled to a UHF transceiver 72. As is known in the art, it would be possible for the reader 13 to have two antennas at 71 that are perpendicular to each other, in order to facilitate more reliable communication between the tag 12 and the reader 13. However, for simplicity and clarity, FIG. 1 shows only one antenna at 71.

In the reader 13, the transceiver 72 is coupled to a microcontroller 73, and the microcontroller 73 is coupled to a network interface 76. The network interface 76 is coupled through a network 77 to the control system 14. In FIG. 1, the network 77 is a type of network that is commonly known in the art as an Ethernet network. However, the network 77 could alternatively be any other suitable type of network or communication system.

Figure 2:
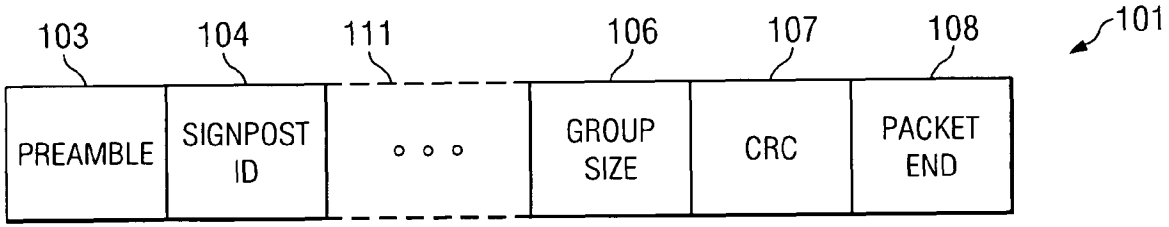
FIG. 2 is a diagrammatic view of a digital word that is embedded in signpost signals transmitted by the signpost of FIG. 1.

FIG. 2 is a diagrammatic view of a digital word 101 that is embedded in the signpost signals transmitted at 24. The bits of the digital word 101 are incorporated into the signpost signal 24 by serially modulating the bits of the word 101 onto the 123 KHz carrier using amplitude modulation, as discussed above. The bits of the word 101 are transmitted serially from left to right in FIG. 2.

The digital word 101 includes several fields. The first field is a preamble 103. The preamble 103 is a predefined pattern of bits that will allow a device receiving the signal 24 to recognize that the signpost signal is beginning, and to synchronize itself to the signpost signal. In the disclosed embodiment, the preamble 103 is approximately eight bits, but the specific number of bits can vary in dependence on factors such as characteristics of a particular receiver that is expected to receive the signpost signal.

The next field 104 in the word 101 is a signpost identification (ID) 104. In the disclosed embodiment, the signpost ID 104 is a 12-bit integer value that uniquely identifies a particular signpost 11 that is transmitting the word 101. As mentioned above, the system 10 may have a number of signposts 11, and the use of a respective different signpost ID 104 by each signpost permits the system to distinguish signpost signals transmitted by one signpost from signpost signals transmitted by another signpost. This does not mean that the system could never have two signposts with exactly the same signpost code. For example, two signposts may be stationarily mounted in close proximity to each other, and may be configured to independently transmit signpost signals that contain the same signpost ID.

Another field in the word 101 is a group size value 106. As discussed in more detail later, this value identifies how many signposts are members of a group of signposts, where the group includes the signpost that transmitted the received signpost signal containing the word 101.

The next field in the word 101 of FIG. 2 is an error control field 107. Communications between the signpost 11 and other devices are essentially one-way transmissions. In addition, many applications for the apparatus 10 of FIG. 1 involve environments that have relatively high noise levels. Accordingly, it is desirable for a receiving device to be able to evaluate whether a word 101 that it received in a signpost signal is correct, or has errors. Consequently, the error control field 107 is included in the word 101 in order to permit the receiving device to identify and/or correct errors. In the disclosed embodiment, the error control field 107 contains a cyclic redundancy code (CRC). However, it would alternatively be possible to use any other suitable error correction scheme, such as parity information, or a forward error correction (FEC) code.

The next field in the word 101 is a packet end field 108. This field signals to a receiving device that the transmission is ending. In the disclosed embodiment, the packet end field 108 has eight bits that are all set to a binary zero. However, the packet end field 108 could alternatively have any other suitable configuration.

It would be possible for the word 101 to have one or more additional fields, for example as indicated diagrammatically at 111. However, even assuming that additional fields were present, it is not necessary to specifically identify and explain them here in order to convey an understanding of the present invention.

As discussed above, the tag 12 has at least two operational modes, including a normal operational mode and a reduced-power sleep mode. When the tag 12 is in the sleep mode and receives a signpost signal 24, the tag can switch from its sleep mode to its normal operational mode. Since the signpost 11 is normally near a reader 13, the tag 12 will in due course respond to the signpost signal 24 by transmitting a type of tag signal 56 that is sometimes referred to as a beacon signal, in order to notify any nearby reader that the tag is present.

Figure 3:
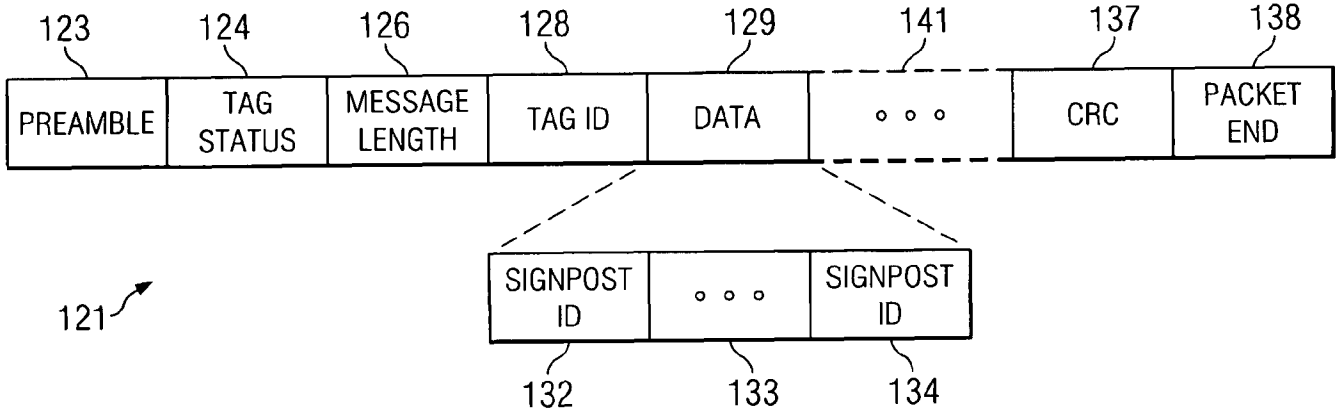
FIG. 3 is a diagrammatic view of a digital word that is transmitted in tag signals transmitted by the tag of FIG. 1.

FIG. 3 is a diagrammatic view of a digital word 121 that the tag can include in its wireless tag signals. As shown in FIG. 3, the word 121 begins with a preamble 123. The preamble 123 is functionally comparable to the preamble 103 in the word 101 of FIG. 2. In the disclosed embodiment, the preamble 123 lasts 1.296 msec, and has 20 cycles that each include a 30 msec logic high and 30 msec logic low, followed by one cycle that includes a 42 msec logic high and then a 54 msec logic low. However, any other suitable preamble could alternatively be used. The next field in the word 121 is a tag status field 124. This field contains some current status information about the tag 12 that is making the transmission.

The next field is a message length field 126, and defines the overall length of the word 121. The message length field 126 is followed by a tag ID field 128. The tag ID field 128 contains a binary code that uniquely identifies the particular tag 12 that transmitted the word 121. Thus, when several tags 12 are present in the vicinity of a particular reader 13, the reader can tell which tag 12 transmitted each signal that the reader receives.

The next field 129 in the word 121 is a data field. The data field 129 contains one or more items of data. In FIG. 3, the data field 129 contains several items of data at 132-134, each of which is a signpost ID such as that shown at 104 in FIG. 2. The signpost IDs at 132-134 were each received in the signpost ID field 104 (FIG. 2) of a respective signpost signal, as explained in more detail later.

The word 121 also includes an error control field 137. In the disclosed embodiment, this is a CRC code, but it could alternatively be any other suitable information for detecting and/or correcting errors. The word 121 ends with a packet end field 138. In the disclosed embodiment, the packet end field 138 is a string of binary zeros representing a logic low that lasts 36 msec. The packet end field 138 indicates to a receiving device that the transmission of the word 121 is ending.

Figure 4:
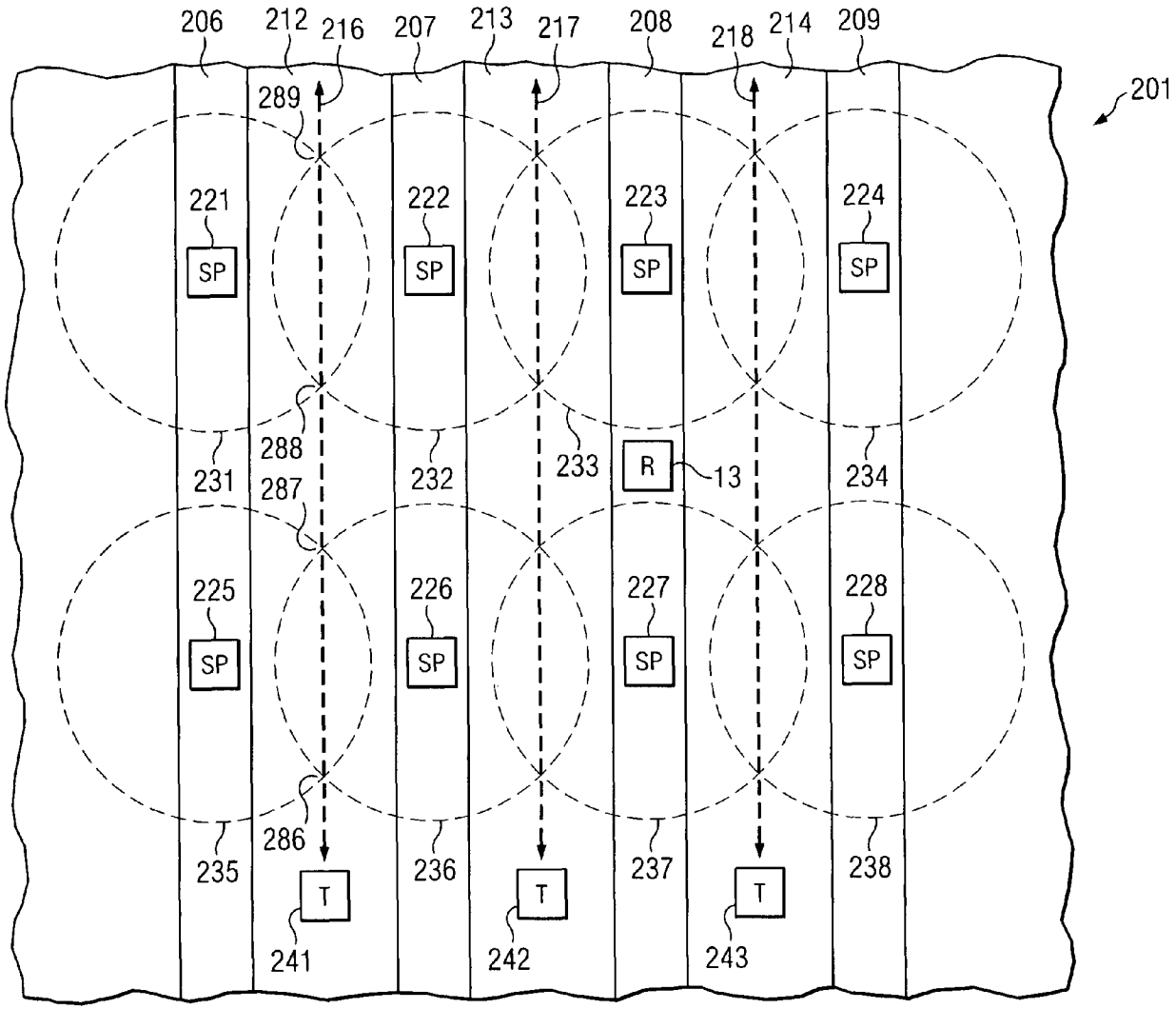
FIG. 4 is a diagrammatic top view showing an arrangement that constitutes one possible application for a system of the type shown in FIG. 1.

FIG. 4 is a diagrammatic top view showing an arrangement that constitutes one possible application for a system of the type shown in FIG. 1. The arrangement 201 includes structure defining four spaced end parallel separators or islands 206-209. Between each adjacent pair of the islands 206-209 is an elongate strip that serves as a lane for vehicles, such as a truck. In particular, the four islands 206-209 define three adjacent and parallel lanes 212-214. Vehicles traveling within the lanes 212-214 move along respective paths of travel 216-218. A vehicle may move in either direction along any of these paths of travel.

The arrangement 201 includes eight signposts 221-228. The signposts 221-228 are each identical to the signpost shown at 11 in FIG. 1, but have been given respective different reference numerals in order to avoid confusion in the discussion that follows. The signposts 221 and 225 are stationarily mounted at spaced locations on the island 206. Similarly, the signposts 222 and 226 are stationarily mounted at spaced locations on the island 207, the signposts 223 and 227 are stationarily mounted at spaced locations on the island 208, and the signposts 224 and 228 are stationarily mounted at spaced locations on the island 209. Although FIG. 4 shows the signposts 221-228 mounted on islands between the lanes, signposts could alternatively be supported at other locations. For example, signposts could be mounted at locations that are each centered above one of the lanes 212-214.

The signposts 221-228 each emit wireless signpost signals containing information of the type discussed above in association with FIG. 2. As also discussed above, the signpost signals from each of the signposts 221-228 have an effective transmission range that is about 4 to 12 feet, and that is indicated diagrammatically in FIG. 4 by a respective one of the broken-line circles 231-238. In the arrangement 201 of FIG. 4, the effective transmission range of each signpost is approximately equal to the width of one of the lanes 212-214. Where two signposts have overlapping transmission ranges, the signposts are synchronized and transmit their signpost signals in an alternating manner, so that the signpost signals do not interfere with each other.

A reader 13 is stationarily supported in approximately the center of the arrangement 201, and in particular is supported on the island 208 at a location between the signposts 223 and 227. The reader 13 in FIG. 1 is identical to the reader 13 of FIG. 1. FIG. 4 also shows three tags 241-243. The tags 241-243 are each identical to the tag shown at 12 in FIG. 1, but have been given different reference numerals in FIG. 4, in order to avoid confusion in the discussion that follows. Each of the tags 241-243 may, for example, be mounted on a truck or other vehicle that is traveling in either direction along one of the lanes 212-214. Thus, for example, if the tag 241 is on a vehicle that is traveling upwardly in FIG. 4 within the lane 212 and along the path of travel 216, the tag 241 will pass through the overlapping transmission ranges 235 and 236 of the signposts 225 and 226, and then in due course will pass through the overlapping transmission ranges 231 and 232 of the signposts 221 and 222.

Figure 5:
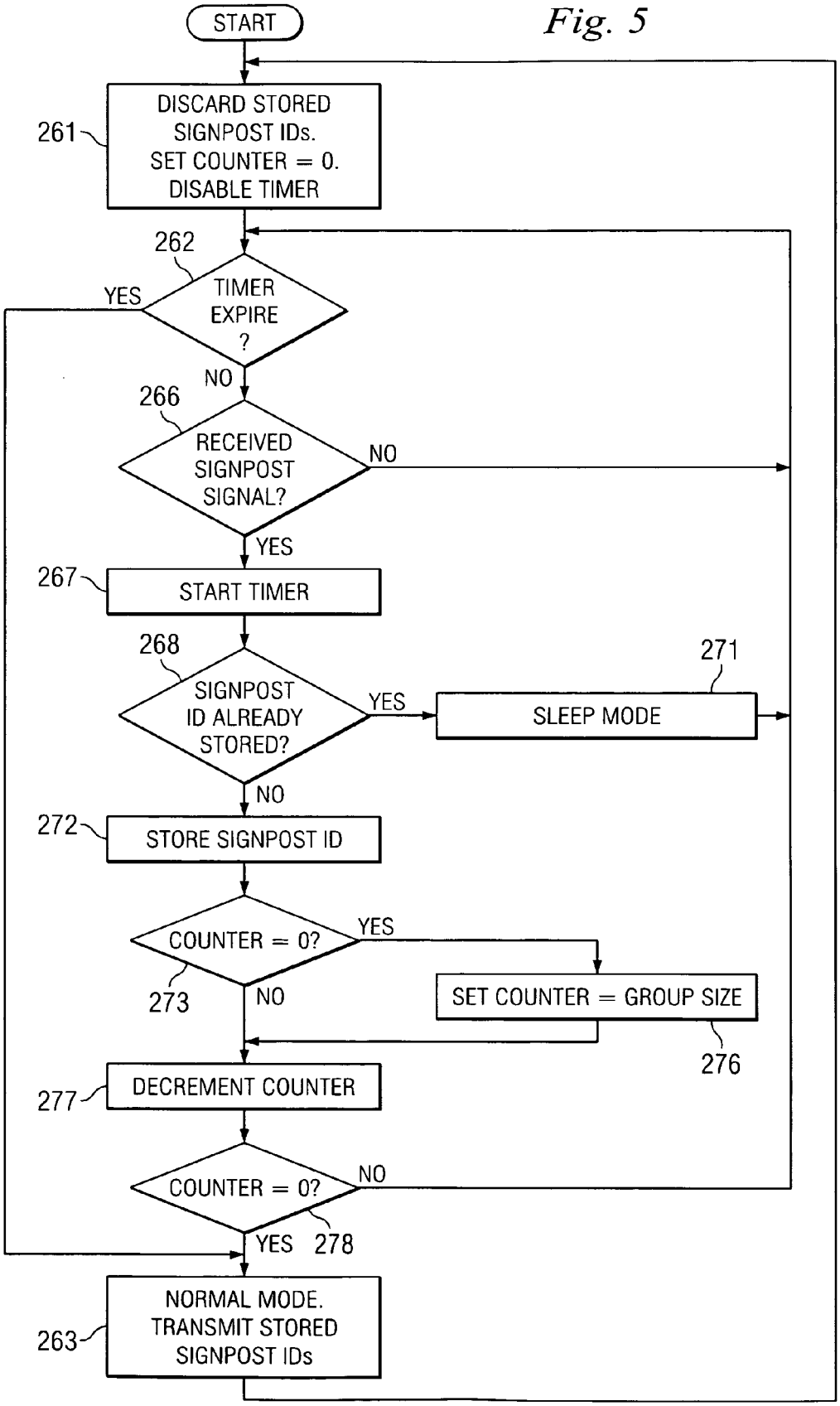
FIG. 5 is a flowchart showing certain operations that are carried out by each of several tags in the embodiment of FIG. 4.

Although FIG. 5 shows the signposts 221-228 supported on the islands 206-209, or in other words at the sides of the lanes 212-214, it would alternatively be possible for some or all of the signposts 221-228 to be supported at other locations. For example, some or all of the signposts could be supported at respective locations that are each centered above one of the lanes 212-214. As a practical matter, when a signpost is supported directly over a lane, it may be necessary to mount it at a relatively high position, so that there will be sufficient clearance for trucks or other tall vehicles to pass beneath it. However, as discussed above, the transmission range of the disclosed signposts is up to about 12 feet. Therefore, a signpost centered above a lane often needs to operate at substantially full power in order for its signal to reach tags supported on vehicles that are low the signpost.

In contrast, where the signpost is supported to the side of a lane, the transmission power is set so that the range is about three-quarters of the width of a lane. As an example, for a lane that is 8 feet wide, signpost power would be set at about half power, so that the range is about 6 to 7 feet. Where this power level is used, signposts would typically be provided on both sides of a lane, in the manner shown in FIG. 4.

FIG. 5 is a flowchart showing certain operations that are carried out by each of the tags 241-243 as they move in either direction along one of the paths of travel 216-218. For simplicity, the flowchart of FIG. 5 will be discussed with reference to the tag 241. For the sake of discussion, it is assumed that the tag 241 is initially in the position shown in FIG. 4, and has not yet entered the transmission range or near field for any of the four tags 221-222 and 225-226. In block 261 of FIG. 5, the tag 241 discards any signpost IDs that it may have previously stored at 47 in the memory 46 of its microcontroller 43 (FIG. 1). The tag 241 disables its counter 48 (FIG. 1) by setting the counter 48 to a value of zero. Further, the tag 241 disables its timer 49 (FIG. 1). The tag 241 then proceeds from block 261 to block 262.

In block 262, the tag checks to see whether the timer 49 has just expired. If so, then the tag would proceed to block 263, which will be discussed later. However, at this particular point, the tag has just disabled the timer in block 261, and thus the tag 241 will determine in block 262 that the timer has not just expired. Consequently, the tag will proceed from block 262 to block 266. In block 266, the tag checks to see whether it has received a signpost signal from any signpost. If not, then the tag returns to block 262, and essentially waits for a signpost signal by sitting in a loop that includes the blocks 262 and 266.

If the tag eventually determines in block 266 that it has received a signpost signal, the tag proceeds to block 267, where it starts the timer 49 (or restarts the timer 49 if the timer is already running). The tag then proceeds to block 268, where it checks to see whether the signpost ID 104 (FIG. 2) in the received signpost signal has already been stored at 47 in the memory 46 (FIG. 1). If so, then the tag proceeds to block 271, where it enters its reduced-power sleep mode, and then returns to block 262 in order to wait for another signpost signal. Blocks 268 and 271 represent one example of a condition that can cause the tag to enter the sleep mode, and is presented here purely by way of example. Any of a variety of conditions or events could alternatively be used to cause the tag to enter the sleep mode while the tag is waiting to receive signpost signals.

If the tag determines in block 268 that the signpost ID 104 in the received signpost signal has not yet been stored at 47, then the tag proceeds to block 272. In block 272, the tag stores the received signpost ID 104 in section 47 of the memory 46. Then, at block 273, the tag checks to see whether the counter 48 (FIG. 1) is currently zero, or in other words whether the counter 48 is currently disabled. If the counter is currently disabled, then the tag proceeds to block 276, where it initializes the counter 48 with the group size value 106 (FIG. 2) from the received signpost signal.

From block 276, or from block 273 if the tag determined that the counter was not disabled, the tag proceeds to block 277, where it decrements the counter 48. Then, at block 278, the tag checks again to see whether the counter 48 has reached zero. If the counter has not yet reached zero, then the tag is still waiting for signpost signals from additional signposts within a group of signposts. The tag therefore returns to block 262 in order to await signpost signals from other signposts in the group. On the other hand, if the tag determines at block 278 that the counter 48 has been decremented to zero, then the tag has received a signpost signal from each of the signposts in the group, and therefore proceeds to block 263.

From the time when the tag detects receipt of a first signpost signal in block 266 until the tag reaches block 263, the tag inhibits the transmission of tag signals at 56 using the UHF transceiver 51. During this time interval, when UHF transmissions are being suppressed, the tag can also optionally conserve battery power by inhibiting reception of wireless signals through the receiver portion of its UHF transceiver 51, or by turning off power to the receiver portion of its UHF transceiver 51.

Referring again to FIG. 4, each of the signposts 221-228 will be transmitting a signpost signal in which the group size value 106 (FIG. 2) is the number 4. This is because a tag traveling along any of the paths of travel 216-218 will pass through the fields or transmission ranges of four tags, and those four tags effectively constitute a group. Stated differently, the four tags 221-222 and 225-226 constitute a group with respect to lane 212, the four tags 222-223 and 226-227 constitute a group with respect to lane 213, and the four tags 223-224 and 227-228 constitute a group with respect to lane 214.

When the tag reaches the point 286, it enters the near fields or transmission ranges 235 and 236 of the tags 225 and 226. Thus, the tag should promptly receive a signpost signal from one of the tags 225 and 226, and then a signpost signal from the other thereof. For the sake of discussion, assume that the first signpost signal received by the tag is from the signpost 225. In response to receipt of this signpost signal, the tag will start its timer 49, and also initialize its counter 48 with the group size value 106 (FIG. 2) from this received signpost signal. Thus, in this example, the counter 48 will be initialized to a value of 4, because the lane 212 is associated with a group of four signposts 221-222 and 225-226. The tag will also take the signpost ID 104 (FIG. 2) from the received signpost signal, and store this signpost ID at 47 (FIG. 1).

Shortly thereafter, the tag should receive a signpost signal from the signpost 226. The tag will restart the timer 49, decrement the counter 48, and then save at 47 the signpost ID 104 for the signpost 226. As the tag continues to move along the path of travel 216, it should receive additional signpost signals from each of the tags 225 and 226. Each of these additional signpost signals will cause the tag to restart its timer 49. Aside from this, however, the tag will essentially ignore these additional signpost signals. In due course, the tag will pass point 287, and will stop receiving signpost signals from the signposts 225 and 226. The time interval measured by the timer 49 is greater than the time needed for the tag to travel from point 287 to point 288 at normal operational speeds. Consequently, the timer 49 will not normally expire as the tag travels from 287 to 288.

When the tag reaches the point 288, it enters the near fields or transmission ranges 231 and 232 of the signposts 221 and 222. The tag 241 will promptly receive a signpost signal from one of the signpost 221 and 222, and then a signpost signal from the other thereof. For the sake of discussion, assume that the first signpost signal received by the tag is from the signpost 221. The tag will store the signpost ID 104 from this signpost signal at 47 in the memory 43. The tag will also restart the timer 49, and decrement the counter 48. Shortly after that, the tag will receive a signpost signal from the signpost 222. The tag will store the signpost ID 104 from this signpost signal in the section 47 of the memory 43, and will also restart the timer 49.

The tag will then decrement the counter 48, and will discover that the counter 48 has reached a value of zero. This tells the tag that a respective signpost signal has been received from each of the four signposts 221-222 and 225-226 in the signpost group that is associated with lane 212. Therefore, as discussed above in association with FIG. 5, the tag will transmit one or more wireless tag signals that contain all of the signpost IDs stored at 47 in the memory 43, in order to transfer this information to the reader 13. In the disclosed embodiment, these signpost IDs are transmitted in the order in which they were successfully stored in the memory 46.

The reader 13 will then forward this information to the control system 14 (FIG. 1). The control system 14 can use this information to make two determinations. First, the control system 14 can determine which of the lanes 212-214 the tag 241 is currently traveling along. In particular, as discussed above, the tag will have received signpost IDs from each of the tags 221-222 and 225-226, and this particular combination of signposts is associated with the lane 212 and the path of travel 216. The second determination made by the control system 14 is the direction in which the tag 241 is currently moving along the path of travel 216. In particular, if the signpost IDs for the signposts 225 and 226 were received before the signpost IDs for the signposts 221 and 222, then the tag 241 is traveling upwardly in FIG. 4 along the path of travel 216. On the other hand, if the signpost IDs for the signposts 221 and 222 were received before the signpost IDs for the signposts 225 and 226, then the tag 241 is traveling downwardly in FIG. 4 along the path of travel 216.

With respect to the example just discussed, and for the sake of explanation, assume that the tag 225 is not transmitting any signpost signals, for example due to a malfunction. As the tag 241 travels from the point 286 to the point 287, it will receive signpost signals from the signpost 226, containing a value in group size field 106 (FIG. 2) that tells the tag to expect to receive signpost signals from each of four different signposts in a group. However, by the time the tag 241 reaches the point 289, it will have received signposts signals from only three signposts, which are the signposts 221-222 and 226. Consequently, the counter 48 will have been decremented to a value of 1, but not to a value of 0. However, after the tag has passed the point 289, the tag will no longer be receiving signpost signals, and will not be repeatedly restarting the timer 49. In due course therefore, the timer 49 will expire, and will cause the tag to transmit the signpost IDs stored at 47. In this case, there will be three rather than four signpost IDs stored at 47, corresponding to the three signposts 221-222 and 226.

Figure 6:
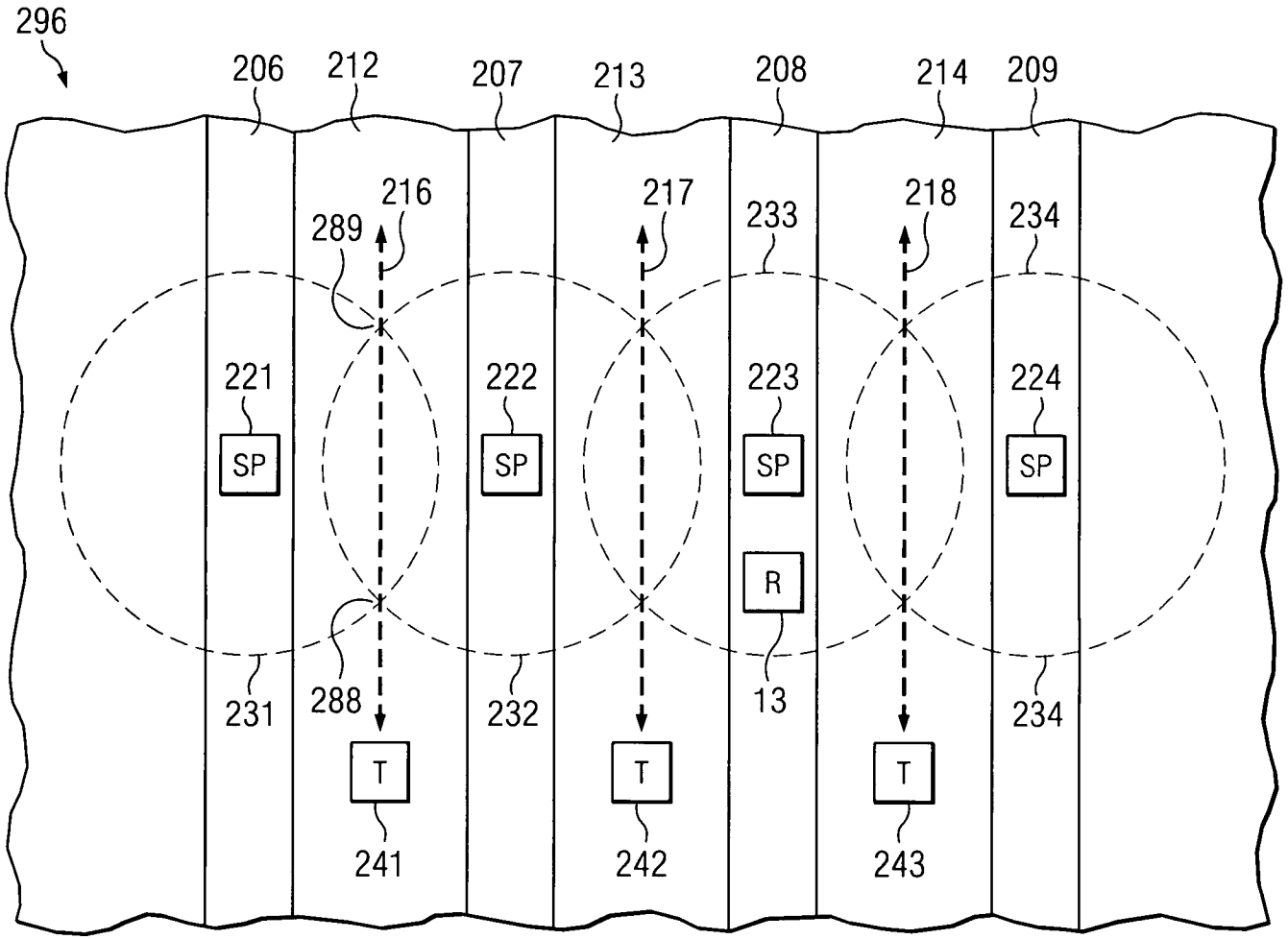
FIG. 6 is a diagrammatic top view of an arrangement that is an alternative embodiment of the arrangement shown in FIG. 4.

FIG. 6 is a diagrammatic top view showing an arrangement 296 that is an alternative embodiment of the arrangement 201 of FIG. 4. More specifically, the four signposts shown at 225-228 in FIG. 4 have been omitted from the arrangement 296 of FIG. 6. In addition, the four signposts 221-224 in FIG. 6 each transmit signpost signals in which the group size field 106 (FIG. 2) contains a value of 2 rather than a value of 4. Aside from this, the arrangement 296 is generally equivalent to the arrangement 201.

In the arrangement 296 of FIG. 6, the information provided from any of the tags 241-243 through the reader 13 to the control system 14 (FIG. 1) is sufficient for the control system 14 to determine which lane that tag is currently traveling along. However, the control system 14 does not receive enough information to determine the direction in which the tag is traveling along the lane.

Figure 7:
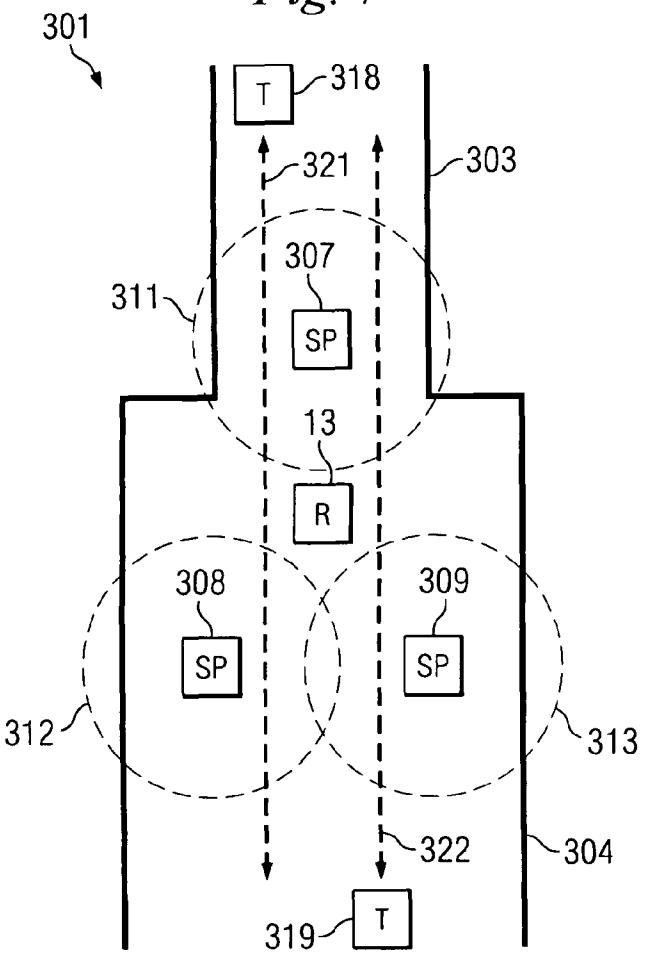
FIG. 7 is a diagrammatic top view of a further arrangement that represents yet another possible application for a system of the type shown in FIG. 1.

FIG. 7 is a diagrammatic top view of a further arrangement 301 that represents yet another possible application for a system of the type shown in FIG. 1. In FIG. 7, a hallway has a narrow portion 303 that opens into a wider portion 304. The near field or transmission range of a typical signpost is not sufficient to cover the entire width of the wider portion 304 of the hallway. Therefore, two signposts are used for the wider portion 304. In particular, as shown in FIG. 7, a single signpost 307 is stationarily mounted on the ceiling in the narrow portion 303 of the hallway, and two transversely spaced signposts 308 and 309 are stationarily mounted on the ceiling in the wider portion 304 of the hallway. The signposts 307-309 are each equivalent to the signpost shown at 11 in FIG. 1, but have been given different reference numerals in FIG. 7 in order to avoid confusion in the discussion that follows. The signposts 307-309 have respective near fields or transmission ranges 311-313, and the transmission ranges 312 and 313 of the two signposts 308 and 309 are together sufficient to cover the full width of the wider portion 304 of the hallway.

In FIG. 7, the signposts 308 and 309 transmit respective signpost signals that contain the same signpost ID 104 (FIG. 2). The signpost 307 transmits signpost signals in which the signpost ID 104 is different from the signpost ID in the signpost signals of the signposts 308 and 309. In the signpost signals transmitted by each of the signposts 307-309, the group size field 106 (FIG. 2) contains a value of 2. The signposts 308-309 are synchronized with each other, and transmit their signpost signals in an alternating manner, so that their signpost signals do not interfere with each other.

In FIG. 7, a reader 13 is stationarily mounted on the ceiling of the hallway, at a position that is disposed approximately centrally between the three tags 307-309. FIG. 7 shows two tags 318 and 319, which are each equivalent to the tag 12 of FIG. 1, and which are each capable of moving within the illustrated hallway. FIG. 7 shows exemplary paths of travel 321 and 322 for the two tags, but the tags are not restricted to these particular paths, and could follow any of a number of other paths as they move along the hallway in either direction. The tags 318 and 319 each operate in a manner similar to that discussed above in association with FIG. 5. Based on information that the tags 318 and 319 transmit through the reader 13 to the control system 14 (FIG. 1), the control system 14 can determine the direction in which a given tag is traveling along the hallway.

Figure 8:
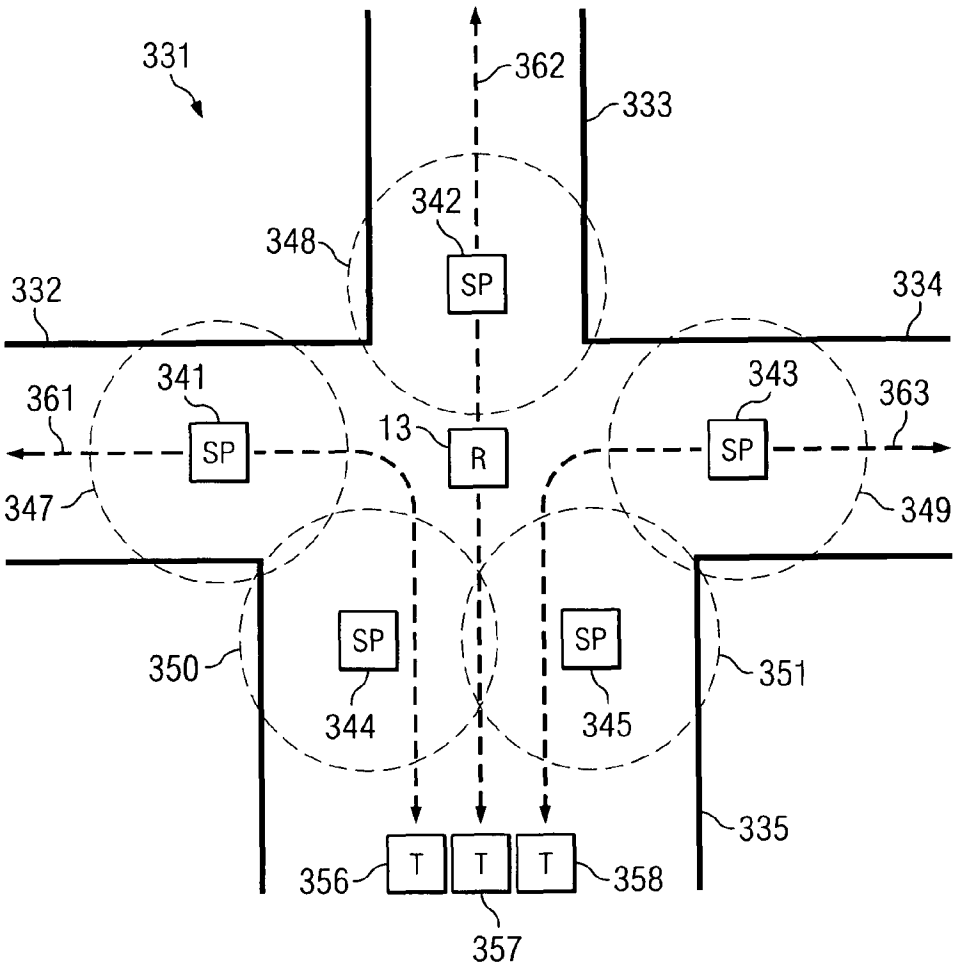
FIG. 8 is a diagrammatic top view of an arrangement that represents still another possible application for a system of the type shown in FIG. 1.

FIG. 8 is a diagrammatic top view of an arrangement 331 that represents still another possible application for a system of the type shown in FIG. 1. In FIG. 8, four hallways 332-335 each extend away from a common intersection in a respective different direction. The hallway 335 is wider than each of the hallways 332-334. The hallways 332-334 each have a respective signpost 341-343 stationarily mounted on the ceiling. The hallway 335 has two transversely spaced signposts 344 and 345 that are stationarily mounted on the ceiling. The signposts 341-345 have respective transmission ranges 347-351.

The signposts 344 and 345 each transmit signpost signals having the same signpost ID 104 (FIG. 2), and are synchronized to transmit their signpost signals in an alternating manner, in order to avoid interference. The signposts 341-343 each transmit signpost signals with respective signpost IDs 104 that are different from each other and from the signpost ID used by the two signposts 344-345. The signpost signals transmitted by each of the signposts 341-345 have a group size field (FIG. 2) that contains a value of 2. A reader 13 is stationarily supported on the ceiling above the common intersection of the four hallways 332-335.

FIG. 8 shows three tags 356-358 that are capable of moving within the hallways 332-335. The tags 356-358 are each equivalent to the tag shown at 12 in FIG. 1, but have been given different reference numerals in FIG. 8 in order to avoid confusion in the discussion that follows. FIG. 8 shows respective exemplary paths of travel 361-363 for the tags 356-358, but the tags are not restricted to these particular paths of travel. The tags 356-358 each operate in a manner similar to that discussed above in association with FIG. 5. Each of the tags 356-358 can transmit information through the reader 13 to the control system 14 (FIG. 1), including signpost IDs stored at 47 (FIG. 1) within the tag. The control system 14 can use this information to determine a current path of travel of a given tag, for example from one of the four hallways 332-335 into another of these four hallways. In addition, the control system 14 can determine the direction in which a given tag is currently moving along its path of travel.

Figure 9:
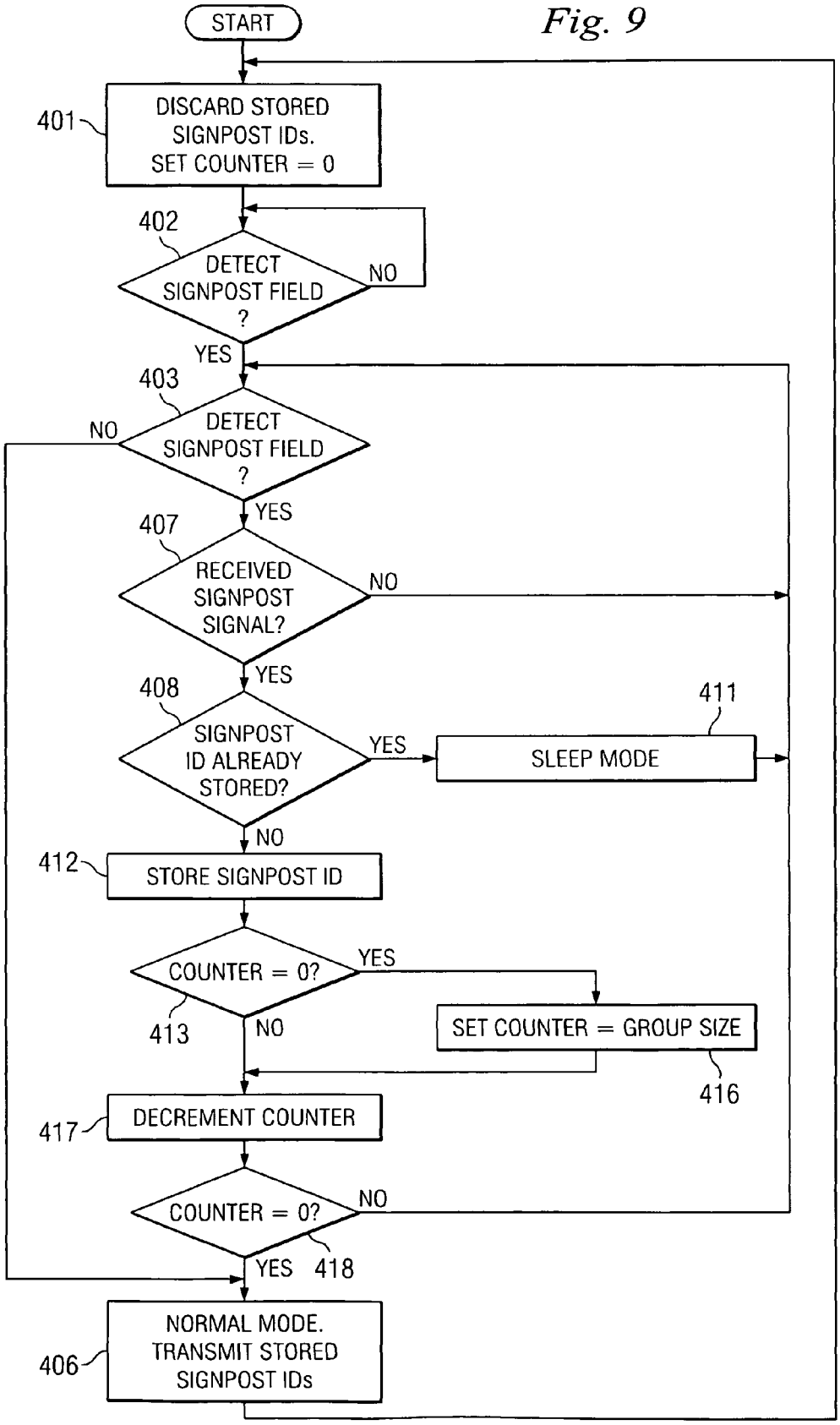
FIG. 9 is a flowchart showing a sequence of operations that can be carried out by a tag, and that is an alternative embodiment of the sequence of operations shown in the flowchart of FIG. 5.

FIG. 9 is a flowchart showing a sequence of operations that can be carried out by a tag, and that is an alternative embodiment of the sequence of operations shown in the flowchart of FIG. 5. With reference to FIG. 1, the receiver 42 within each tag is capable of detecting whether or not the tag is currently within the primarily magnetic near field of any signpost, and thus within the transmission range of a signpost. FIG. 9 differs from FIG. 5 primarily in that the tag does not use the timer 49 (FIG. 1), but instead monitors whether or not the tag is currently within the magnetic near field of any signpost, or in other words within the transmission range of any signpost.

More specifically, in block 401 of FIG. 9, the tag discards any signpost IDs that the tag may have previously stored in 47 in the memory 46 (FIG. 1). The tag also disables the counter 48 by setting it to zero. Then, at block 402, the tag checks to see whether its receiver 42 is currently detecting the magnetic field of any signpost. If not, then the tag remains at block 402, waiting to enter a signpost field. If the tag eventually does enter a signpost field, then it proceeds to block 403, where it again checks for the presence of a signpost field. If the tag were to detect the absence of a signpost field, then the tag would proceed to block 406, which is discussed later. But when the tag first encounters block 403, the signpost field will still be present, and the tag will proceed to block 407.

In block 407, the tag checks to see whether it has actually received a signpost signal. If not, then it returns to block 403 to wait for a signpost signal. If it eventually determines in block 407 that is has received a signpost signal, the tag proceeds to block 408, where it checks to see if the signpost ID 104 (FIG. 2) in the received signpost signal has already been stored in its memory at 47 (FIG. 1). If so, then the tag enters its sleep mode at block 411, and returns to block 403. Otherwise, the tag proceeds from block 408 to block 412, where it stores the received signpost ID in its memory at 47.

The tag then proceeds to block 413, where it checks to see if the counter is currently zero. If so, then the counter has not been initialized, and the tag proceeds to block 416, where it initializes the counter 48 with the value from the group size field 106 (FIG. 2) in the received signpost signal. From 416, or from block 413 if the tag determines that the counter is not zero, the tag proceeds to block 417, where it decrements the counter. Then, at block 418, the tag checks to see if the counter has reached zero, or in other words whether the tag has received a respective signpost signal from each signpost in the group. If not, then the tag returns to block 403 and waits to receive a signpost signal from another signpost. Otherwise, the tag proceeds from block 418 to block 406. In block 406, the tag switches to its normal operational mode (if it is not already in the normal mode). Then, the tag transmits all of the signpost IDs stored at 47 in its memory, using one or more tag signals of the type shown in FIG. 3. The stored signpost IDs would be inserted into respective fields, such as those shown at 132-134 in FIG. 3.

From the time when the tag first detects a signpost field in block 402 until the tag reaches block 406, the tag inhibits the transmission of tag signals at 56 using the UHF transceiver 51. During this time interval, when UHF transmissions are being suppressed, the tag can also optionally conserve battery power by inhibiting reception of wireless signals through the receiver portion of its UHF transceiver 51, or by turning off power to the receiver portion of its UHF transceiver 51.

Figure 10:
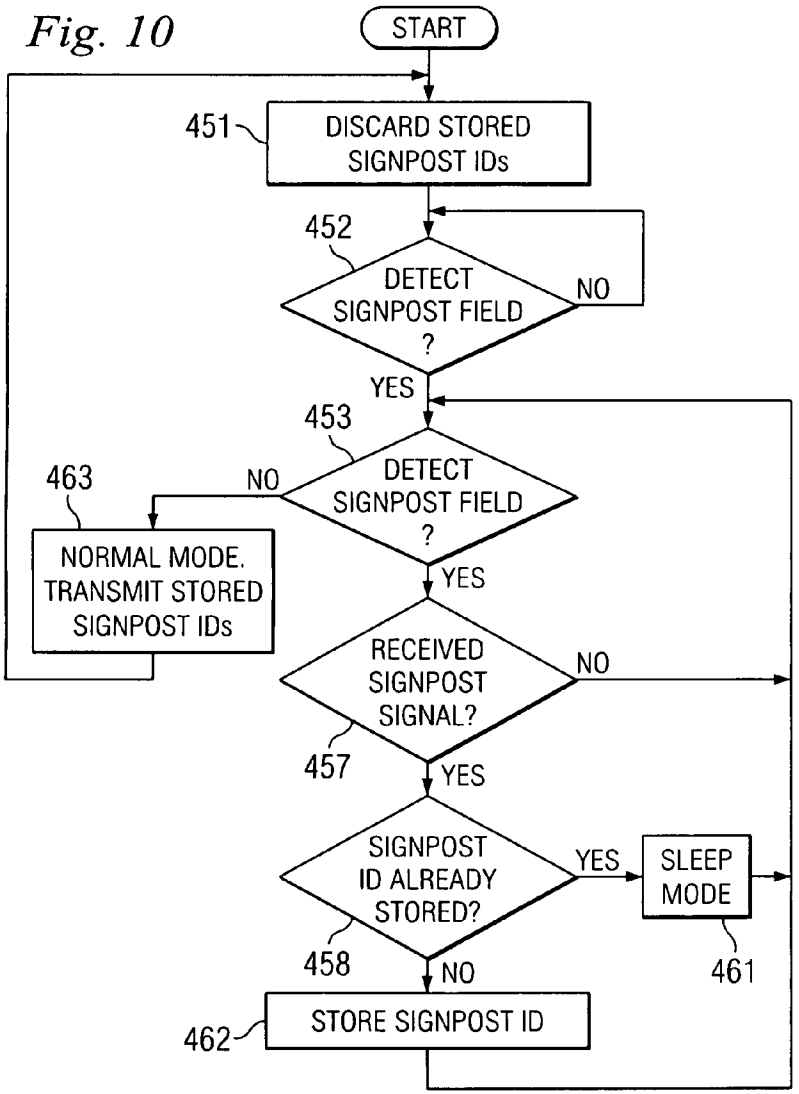
FIG. 10 is a flowchart showing a sequence of operations that can be carried out by a tag, and that is an alternative embodiment of the sequences of operation shown in the flowcharts of FIGS. 5 and 9.

FIG. 10 is a flowchart showing a sequence of operations that can be carried out by a tag, and that is an alternative embodiment of the sequences of operation shown in the flowcharts of FIGS. 5 and 9. The flowchart of FIG. 10 differs from the flowchart of FIG. 9 primarily in that the counter 48 is not used. In other words, the tag does not look for signpost signals from a specific number of signposts that collectively form a group. In block 451 of FIG. 10, the tag discards any signposts IDs that it may have previously stored at 47 in its memory 46. Then, at block 452, the tag checks to see whether its receiver 42 is currently detecting the presence of a magnetic field from any signpost. If not, the tag waits at block 452 until a magnetic signpost field is detected. When a magnetic field is detected, the tag proceeds to block 453, where it again checks for the presence of a magnetic signpost field. When the tag first moves from block 452 to block 453, it will find that there is a magnetic signpost field, and it will therefore proceed from block 453 to block 457. In block 457, the tag checks to see whether it has received a signpost signal. If not, then it returns to block 453 in order to wait for a signpost signal. On the other hand, if it has received a signpost signal, then the tag proceeds to block 458.

In block 458, the tag checks to see whether the signpost ID 104 (FIG. 2) in the received signpost signal is already stored in its memory at 47 (FIG. 1). If so, the tag enters its sleep mode at block 461, and returns to block 453 in order to wait for another signpost signal. Otherwise, the tag proceeds from block 458 to block 462, where it stores the received signpost ID in its memory at 47, and then returns to block 453.

The tag may pass through overlapping fields of two or more signposts, but the tag will eventually move to a location where, in block 453, it does not detect a magnetic field from any signpost. The tag will proceed to block 463. In block 463, the tag returns to its normal operational mode (if it is not already in the normal mode). Then, the tag transmits all signpost IDs that it has stored in 47, using one or more tag signals of the type shown in FIG. 3. The respective signpost IDs will appear in respective fields, such as those shown at 132-134 in FIG. 3.

From the time when the tag detects a signpost field in block 452 until the tag reaches block 463, the tag inhibits the transmission of tag signals at 56 using the UHF transceiver 51. During this time interval, when UHF transmissions are being suppressed, the tag can also optionally conserve battery power by inhibiting reception of wireless signals through the receiver portion of its UHF transceiver 51, or by turning off power to the receiver portion of its UHF transceiver 51.

Figure 11:
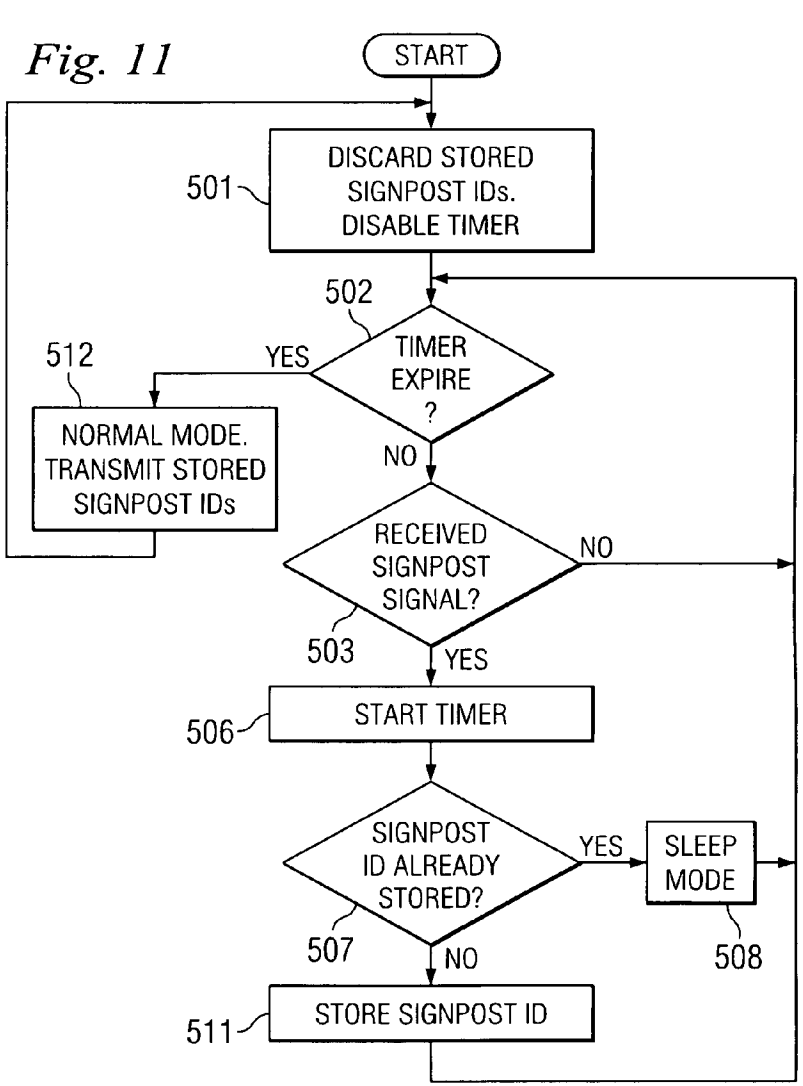
FIG. 11 is a flowchart showing a sequence of operations that can be carried out by a tag, and that is an alternative embodiment of the sequences of operations shown in the flowcharts of FIGS. 5, 9 and 10.

FIG. 11 is a flowchart showing a sequence of operations that can be carried out by a tag, and that is an alternative embodiment of the sequences of operations shown in the flowcharts of FIGS. 5, 9 and 10. The primary difference is that, in the flowchart of FIG. 11, the tag relies specifically on the timer 49 to determine when to transmit received signpost IDs. More specifically, in block 501 of FIG. 11, the tag discards any signpost IDs that it may have previously stored in its memory at 47 (FIG. 1). The tag also disables the timer 49. Then, in block 502, the tag checks to see whether the timer has just expired. When the tag first encounters the block 502, the tag will have just disabled the timer 49 in block 501, and thus the tag will determine that the timer has not just expired. The tag will therefore proceed to block 503, where it will check to see if it has actually received a signpost signal. If not, then it returns to block 502 to wait for a signpost signal. But if it has received a signpost signal, the tag will proceed from block 503 to block 506, where it starts the timer 49.

Then, in block 507, the tag checks to see whether the signpost ID 104 (FIG. 2) in the received signpost signal is already stored in its memory at 47 (FIG. 1). If so, then the tag enters the sleep mode at 508, and returns to block 502 in order to wait for another signpost signal. Otherwise, the tag proceeds from block 507 to block 511, where it stores the received signpost ID in its memory at 47. The tag then returns to block 502, in order to wait for another signpost signal.

Each time the tag receives a signpost signal, it will restart its timer 49 in block 506, such that the timer does not have an opportunity to expire. Eventually, however, the tag will travel to a location outside the transmission ranges of all signposts. As a result, the tag will not be receiving any signpost signals, and therefore will not be restarting the timer at block 506. Consequently, the timer 49 will expire in due course, and the tag will detect this at block 502 and proceed to block 512.

In block 512, the tag enters its normal operational mode (if it is not already in the normal mode). The tag then transmits the signpost IDs that it stored at 47 in its memory, using one or more tag signals of the type shown in FIG. 3. The signpost IDs would appear in respective fields, such as those shown in at 132-134 in FIG. 3.

From the time when the tag detects receipt of a first signpost signal in block 503 until the tag reaches block 512, the tag inhibits the transmission of tag signals at 56 using the UHF transceiver 51. During this time interval, when UHF transmissions are being suppressed, the tag can also optionally conserve battery power by inhibiting reception of wireless signals through the receiver portion of its UHF transceiver 51, or by turning off power to the receiver portion of its UHF transceiver 51.

Although selected embodiments have been illustrated and described in detail, it should be understood that a variety of substitutions and alterations are possible without departing from the spirit and scope of the present invention, as defined by the claims that follow.

What is claimed is:

1. An apparatus comprising:

first and second signposts that are supported at spaced locations, and that each transmit wireless signpost signals having a transmission range and containing a signpost identification, the signpost identification in signpost signals from said first signpost being different from the signpost identification in signpost signals from said second signpost; and structure defining spaced first and second paths of travel that are approximately parallel, said second signpost being disposed between said first and second paths of travel, said first path of travel passing through the transmission range of signpost signals from said first signpost and through the transmission range of signpost signals from said second signpost, said second path of travel passing through the transmission range of signpost signals from said second signpost, and said second path of travel being outside the transmission range of signpost signals from said first signpost;

wherein said structure defines spaced first and second lanes for vehicles, said first and second paths of travel respectively extending along said first and second lanes, said first and second signposts being disposed on opposite sides of said first lane, wherein the transmission range of the first signpost is less than or equal to a width of the first lane and the transmission range of the second signpost is less than or equal to a width of the second lane.

2. An apparatus according to claim 1, including a reader configured to receive wireless tag signals that are different from said signpost signals and that originate within a reception range of said reader, said first and second signposts each being disposed within said reception range of said reader.

3. An apparatus according to claim 2, including a tag that can be moved relative to said signposts and that includes:

a receiver section configured to receive wireless signpost signals transmitted by either of said first and second signposts;

a transmitter section that can transmit wireless tag signals; and a further section that causes said transmitter section to include in at least one of the wireless tag signals each signpost identification received by said receiver section in signpost signals from either of said first and second signposts.

4. An apparatus according to claim 3, further comprising a control system, the control system determining which of said paths of travel said tag is currently moving along based on the signpost identifications received by the reader in the wireless tag signals.

5. An apparatus according to claim 1, including a third signpost that transmits wireless signpost signals having a transmission range and containing a signpost identification different from the signpost identifications in signpost signals from said first and second signposts, said third signpost being spaced from said first and second signposts in a direction parallel to said paths of travel, at least one of said first and second paths of travel passing through the transmission range of signpost signals from said third signpost.

6. An apparatus comprising:

first and second signposts that are supported at spaced locations, and that each transmit wireless signpost signals having a transmission range and containing a signpost identification, the signpost identification in signpost signals from said first signpost being different from the signpost identification in signpost signals from said second signpost;

structure defining spaced first and second paths of travel that are approximately parallel, said first path of travel passing through the transmission range of signpost signals from said first signpost, said second path of travel passing through the transmission range of signpost signals from said second signpost, and said second path of travel being outside the transmission range of signpost signals from said first signpost; and a third signpost that is supported at a location spaced from said first and second signposts, and that transmits wireless signpost signals having a transmission range and containing a signpost identification different from the signpost identifications in signpost signals from said first and second signposts, said second path of travel passing through the transmission range of signpost signals from said third signpost, and said first path of travel passing through the transmission range of signpost signals from one of said second and third signposts and being outside the transmission range of signpost signals from the other thereof;

wherein said structure defines spaced first and second lanes for vehicles, said first and second paths of travel respectively extending along said first and second lanes, said second signpost being disposed between said first and second lanes, said first signpost being disposed on a side of said first lane opposite from said second signpost, and said third signpost being disposed on a side of said second lane opposite from said second signpost, wherein the transmission range of the first signpost is less than or equal to a width of the first lane and the transmission range of the second signpost is less than or equal to a width of the second lane.

7. An apparatus according to claim 6, including a reader configured to receive wireless tag signals that are different from said signpost signals and that originate within a reception range of said reader, said first, second and third signposts each being disposed within said reception range of said reader.

8. An apparatus according to claim 7, including a tag that can be moved relative to said signposts and that includes:

a receiver section configured to receive wireless signpost signals transmitted by any of said first, second and third signposts;

a transmitter section that can transmit wireless tag signals; and a further section that causes said transmitter section to include in at least one of the wireless tag signals each signpost identification received by said receiver section in a signpost signal from any of said first, second and third signposts.

9. An apparatus according to claim 8, wherein said further section also causes said transmitter section to include in at least one of the wireless tag signals information representing an order in which signpost signals from any of said first, second and third signposts were received by said tag.

10. An apparatus according to claim 8, further comprising a control system determining at least one of a current direction of movement of said tag along one of said paths of travel, and which of said paths of travel said tag is currently moving along based on the signpost identifications received by the reader in the wireless tag signals.

11. An apparatus comprising:

first and second signposts that are supported at spaced locations, and that each transmit wireless signpost signals having a transmission range and containing a signpost identification, the signpost identification in signpost signals from said first signpost being different from the signpost identification in signpost signals from said second signpost;

structure defining spaced first and second paths of travel that are approximately parallel, said second signpost being disposed between said first and second paths of travel, said first path of travel passing through the transmission range of signpost signals from said first signpost and through the transmission range of signpost signals from said second signpost, said second path of travel passing through the transmission range of signpost signals from said second signpost, and said second path of travel being outside the transmission range of signpost signals from said first signpost;

a third signpost that transmits wireless signpost signals having a transmission range and containing a signpost identification different from the signpost identifications in signpost signals from said first and second signposts, said third signpost being spaced from said first and second signposts in a direction parallel to said paths of travel, at least one of said first and second paths of travel passing through the transmission range of signpost signals from said third signpost; and a fourth signpost that transmits wireless signpost signals having a transmission range and containing a signpost identification different from the signpost identifications in signpost signals from said first, second and third signposts, said fourth signpost being spaced from said third signpost, and being spaced from said first and second signposts in a direction parallel to said paths of travel, said one of said first and second paths of travel being outside the transmission range of signpost signals from said fourth signpost, and the other of said first and second paths of travel passing through the transmission range of signpost signals from said fourth signpost.

12. A method comprising:

transmitting wireless signpost signals from each of first and second signposts that are supported at spaced locations, said wireless signpost signals each being a near field signal having a transmission range and containing a signpost identification, the signpost identification in the near field signpost signals from said first signpost being different from the signpost identification in the near field signpost signals from said second signpost;

providing structure that defines spaced first and second lanes for vehicles, said first and second lanes extending approximately parallel to each other, wherein the transmission range of the first signpost is less than or equal to a width of the first lane and the transmission range of the second signpost is less than or equal to a width of the second lane; and defining spaced first and second paths of travel that are approximately parallel and that respectively extend along said first and second lanes, said second signpost being disposed between said first and second lanes, said first path of travel passing through the transmission range of the near field signpost signals from said first signpost and through the transmission range of the near field signpost signals from said second signpost, said second path of travel passing through the transmission range of the near field signpost signals from said second signpost, and said second path of travel being outside the transmission range of the near field signpost signals from said first signpost.

13. A method according to claim 12, including receiving wireless tag signals in a reader supported so that said first and second signposts are each disposed within a reception range of said reader, said wireless tag signals being different from said signpost signals and originating within the reception range of said reader.

14. A method according to claim 13, including:

providing a tag that can be moved relative to said signposts, that can transmit wireless tag signals, and that can receive wireless signpost signals transmitted by either of said first and second signposts; and causing said tag to transmit wireless tag signals and to include in at least one of the wireless tag signals each signpost identification received by said tag in signpost signals from either of said first and second signposts.

15. A method according to claim 14, including responding to the signpost identifications received by said reader in said wireless tag signals by determining which of said paths of travel said tag is currently moving along.

16. A method according to claim 12, including:

supporting a third signpost at a location spaced from said first and second signposts in a direction parallel to said paths of travel;

transmitting from said third signpost wireless signpost signals that are near field signals having a transmission range and containing a signpost identification different from the signpost identifications in signpost signals from said first and second signposts; and wherein said defining of said first and second paths of travel includes positioning at least one of said first and second paths of travel so that it passes through the transmission range of signpost signals from said third signpost.

17. A method according to claim 12, including configuring said near field wireless signpost signals transmitted by each of said first and second signposts to be near field signals of primarily magnetic character.

18. A method comprising:

transmitting wireless signpost signals from each of first and second signposts that are supported at spaced locations, said wireless signpost signals each being a near field signal having a transmission range and containing a signpost identification, the signpost identification in the near field signpost signals from said first signpost being different from the signpost identification in the near field signpost signals from said second signpost;

providing structure that defines spaced first and second lanes for vehicles, said first and second lanes extending approximately parallel to each other, wherein the transmission range of the first signpost is less than or equal to a width of the first lane and the transmission range of the second signpost is less than or equal to a width of the second lane;

defining spaced first and second paths of travel that are approximately parallel and that respectively extend along said first and second lanes, said first path of travel passing through the transmission range of the near field signpost signals from said first signpost, said second path of travel passing through the transmission range of the near field signpost signals from said second signpost, and said second path of travel being outside the transmission range of the near field signpost signals from said first signpost;

supporting a third signpost at a location spaced from said first and second signposts; and transmitting near field wireless signpost signals from said third signpost having a transmission range and containing a signpost identification different from the signpost identifications in the near field signpost signals from said first and second signposts;

wherein said defining of said first and second paths of travel includes positioning said second path of travel so that it passes through the transmission range of the near field signpost signals from said third signpost, and positioning said first path of travel so that it passes through the transmission range of the near field signpost signals from one of said second and third signposts and is outside the transmission range of the other thereof.

19. A method according to claim 18, including receiving wireless tag signals in a reader supported so that said first, second and third signposts are each disposed within a reception range of said reader, said wireless tag signals being different from said signpost signals, and originating within a reception range of said reader.

20. A method according to claim 19, including:

providing a tag that can be moved relative to said signposts, that can transmit wireless tag signals, and that can receive wireless signpost signals transmitted by any of said first, second and third signposts; and causing said tag to include in at least one of the wireless tag signals each signpost identification received by said tag in a signpost signal from any of said first, second and third signposts.

21. A method according to claim 20, including causing said tag to include in at least one of the wireless tag signals information representing an order in which signpost signals from any of said first, second and third signposts were received by said tag.

22. A method according to claim 20, including responding to the signpost identifications in said wireless tag signals received by said reader by determining at least one of:

a current direction of movement of said tag along one of said paths of travel; and which of said paths of travel said tag is currently moving along.

23. A method according to claim 18, including configuring said near field wireless signpost signals transmitted by each of said first, second and third signposts to be near field signals of primarily magnetic character.

24. A method comprising:

transmitting wireless signpost signals from each of first and second signposts that are supported at spaced locations, said wireless signpost signals each having a transmission range and containing a signpost identification, the signpost identification in signpost signals from said first signpost being different from the signpost identification in signpost signals from said second signpost;

defining spaced first and second paths of travel that are approximately parallel, said second signpost being disposed between said first and second paths of travel, said first path of travel passing through the transmission range of signpost signals from said first signpost and through the transmission range of signpost signals from said second signpost, said second path of travel passing through the transmission range of signpost signals from said second signpost, and said second path of travel being outside the transmission range of signpost signals from said first signpost;

supporting a third signpost at a location spaced from said first and second signposts in a direction parallel to said paths of travel;

transmitting from said third signpost wireless signpost signals having a transmission range and containing a signpost identification different from the signpost identifications in signpost signals from said first and second signposts, wherein said defining of said first and second paths of travel includes positioning at least one of said first and second paths of travel so that it passes through the transmission range of signpost signals from said third signpost;

supporting a fourth signpost at a location spaced from said third signpost, and spaced from said first and second signposts in a direction parallel to said paths of travel;

transmitting from said fourth signpost wireless signpost signals having a transmission range and containing a signpost identification different from the signpost identifications in signpost signals from said first, second and third signposts; and wherein said defining of said first and second paths of travel includes positioning said one of said first and second paths of travel so that it is outside the transmission range of signpost signals from said fourth signpost, and positioning the other of said first and second paths of travel so that it passes through the transmission range of signpost signals from said fourth signpost.

25. An apparatus comprising:

structure defining a plurality of hallways that each extend away from a common intersection in a respective different direction; and a plurality of signposts that are each supported in a respective said hallway and that each transmit wireless signpost signals having a transmission range and containing a signpost identification, the signpost identification in signpost signals from each said signpost being different from the signpost identification in signpost signals from each of the other said signposts;

wherein one of said hallways has two of said signposts therein that are transversely spaced and that transmit respective signpost signals containing the same said signpost identification, said one hallway being wider than the transmission range of signpost signals transmitted by either of the signposts in that hallway.

26. An apparatus according to claim 25, including a tag that can be moved relative to said signposts and that includes:

a receiver section configured to receive wireless signpost signals transmitted by any of said signposts;

a transmitter section that can transmit wireless tag signals that are different from said signpost signals; and a further section that causes said transmitter section to include in at least one of the wireless tag signals each signpost identification received by said receiver section in a signpost signal from any of said signposts.

27. An apparatus according to claim 26, including:

a reader configured to receive the wireless tag signals; and a section responsive to signpost identifications received by said reader in said wireless tag signals for determining at least one of:

a path of travel of said tag; and a current direction of movement of said tag.

28. A method comprising:

supporting each of a plurality of signposts in a respective one of a plurality of hallways that each extend away from a common intersection in a respective different direction;

transmitting from each said signpost wireless signpost signals that have a transmission range and that contain a signpost identification, the signpost identification in signpost signals from each said signpost being different from the signpost identification in signpost signals from each of the other said signposts;

supporting a further signpost in one said hallway so that said signposts in said one hallway are transversely spaced; and transmitting from said further signpost wireless signpost signals that have a transmission range and that contain a signpost identification, the signpost signals transmitted by each of said signposts in said one hallway containing the same signpost identification, and said one hallway being wider than the transmission range of signpost signals transmitted by either of the signposts in that hallway.

29. A method according to claim 28, including:

providing a tag that can be moved relative to said signposts, that can transmit wireless tag signals different from said signpost signals, and that can receive wireless signpost signals transmitted by any of said signposts; and causing said tag to include in at least one of the wireless tag signals each signpost identification received by said tag in a signpost signal from any of said signposts.

30. A method according to claim 29, including:

receiving wireless tag signals in a reader supported so that said signposts are each disposed within a reception range of said reader; and responding to signpost identifications received by said reader in said wireless tag signals by determining at least one of:

a path of travel of said tag; and a current direction of movement of said tag.

31. An apparatus comprising:

structure defining a hallway having a first portion with a first width and a second portion with a second width greater than said first width; and a first signpost supported in said first portion of said hallway, and transversely spaced second and third signposts supported in said second portion of said hallway, said signposts each transmitting wireless signpost signals that have a transmission range and that each contain a signpost identification, the signpost identification in signpost signals from each of said second and third signposts being the same, and the signpost identification in signpost signals transmitted by said first signpost being different from the signpost identification in signpost signals from said second and third signposts, and said second width being greater than the transmission range of signpost signals from either of said second and third signposts.

32. An apparatus according to claim 31, including a tag that can be moved relative to said signposts and that includes:

a receiver section configured to receive wireless signpost signals transmitted by any of said signposts;

a transmitter section that can transmit wireless tag signals that are different from said signpost signals; and a further section that causes said transmitter section to include in at least one of the wireless tag signals each signpost identification received by said receiver section in a signpost signal from any of said signposts.

33. An apparatus according to claim 32, including:

a reader configured to receive the wireless tag signals; and a section responsive to the signpost identifications received by said reader in said wireless tag signals for determining a current direction of movement of said tag.

34. A method comprising:

supporting a first signpost in a first portion of a hallway, said first portion having a first width; and supporting transversely spaced second and third signposts in a second portion of said hallway having a second width greater than said first width; and transmitting from each said signpost wireless signpost signals that have a transmission range and that each contain a signpost identification, the signpost identification in signpost signals from each of said second and third signposts being the same, and the signpost identification in signpost signals transmitted by said first signpost being different from the signpost identification in signpost signals from said second and third signposts, and said second width being greater than the transmission range of signpost signals from either of said second and third signposts.

35. A method according to claim 34, including:

providing a tag that can be moved relative to said signposts, that can transmit wireless tag signals different from said signpost signals, and that can receive wireless signpost signals transmitted by any of said signposts; and causing said tag to include in at least one of the wireless tag signals each signpost identification received by said tag in a signpost signal from any of said signposts.

36. A method according to claim 35, including:

receiving wireless tag signals in a reader supported so that said signposts are each disposed within a reception range of said reader; and responding to signpost identifications received by said reader in said wireless tag signals by determining a current direction of movement of said tag.

* * * * *